United States Patent [19]

Holland

[11] 4,329,937

[45] May 18, 1982

[54] PIPE LINING APPARATUS

[75] Inventor: Henry A. N. Holland, Houston, Tex.

[73] Assignee: Raymond International Builders, Inc., Houston, Tex.

[21] Appl. No.: 244,870

[22] Filed: Mar. 18, 1981

[51] Int. Cl.[3] ..... B05C 11/02

[52] U.S. Cl. ..... 118/105; 118/108; 118/112; 118/118; 118/306; 118/315; 118/323; 118/DIG. 10

[58] Field of Search ..... 118/306, DIG. 10, 105, 118/108, 112, 118, 315, 323

[56] References Cited

U.S. PATENT DOCUMENTS 2,261,928 11/1941 Perkins et al. ..... 118/105

3,164,491 1/1965 Brockett et al. ..... 118/72

*Primary Examiner*—Bernard D. Pianalto

*Attorney, Agent, or Firm*—Fitzpatrick, Cella, Harper & Scinto

[57] ABSTRACT

This invention relates to apparatus for lining or coating the interior of lengths of large diameter, e.g. sixty inch (152.4 cm) pipe by applying fluent material thereto, and more specifically relates to such apparatus wherein a pipe liner vehicle travels through the pipe applying the material as it moves therethrough.

19 Claims, 8 Drawing Figures

PIPE LINING APPARATUS

BACKGROUND OF THE INVENTION

Description of the Prior Art

It is well known that the useful life of large diameter pipes, such as sewage pipes, water conduits, and the like, can be prolonged by coating their interiors with a protective lining, thereby preventing corrosion. Consequently, numerous apparatus and devices have been proposed to perform this coating operation. Typically a vehicle of some kind is provided with an application head, or distributor, which applies fluent coating material radially outward, and the vehicle is made to pass through the interior of the pipe. Troweling arrangements are frequently provided as well to smooth the surface of the applied coating, after which the coating is allowed to harden. Such a device is disclosed in U.S. Pat. No. 3,810,441 which issued on May 14, 1974 to Clifford A. Padgett.

Such pipes can be quite large, however, diameters of five feet and more not being uncommon, and the lining devices for such pipes must therefore also be quite large. This gives rise to problems in transferring either the lengths of pipe and/or the lining vehicle between lining operations and also in aligning the two once they are brought together. A proposed approach to this problem is disclosed in U.S. Pat. No. 3,164,491 which issued on Jan. 5, 1965 to Jay K. Brockett et al. According to this patent, a length of straight track is laid extending toward an apparatus for supporting a length of pipe and rotating it about its central axis. A special cleaning and lining vehicle is provided having a "primary carriage" which rides on the track. A long boom which extends from the primary carriage carries a cleaning/lining apparatus which is inserted into the length of pipe as the primary carriage is advanced along the track. The cleaning and lining operation is performed as the apparatus is backed out of the pipe and the pipe is rotated.

While this arrangement appears to facilitate aligning the lining apparatus and the pipe, it presents a disadvantage in that it necessitates considerable handling of the pipe, including lifting and transporting, both before and after the lining operation. Not only is this time consuming, but it also creates a risk of dislodging the applied coating before it was hardened, which would necessitate costly and time consuming recleaning and relining of the pipe.

Another problem presented in the use of these lining arrangements is that of delivering sufficient lining material to the lining machine so that the lining operation can be performed in one pass through the pipe. U.S. Pat. No. 2,261,928 which issued on Nov. 4, 1941 to A. G. Perkins et al. discloses a pipe lining vehicle which has a centrifugal type applicator and trailing troweling arrangement. The vehicle supports two interconnected cement mixing "hoppers", the more forward of the two being placed somewhat higher on the vehicle than the more rearward one. A pair of "feed pipes" convey cement and water to the forward hopper where it is mixed by rotating paddles. When this hopper is sufficiently full the cement mixture is picked up by a screw conveyor which passes the mixture to the rearward hopper, where it presumably falls to the bottom thereof by gravitational action. It is there further mixed by a second rotating paddle arrangement. Finally, the mixture is picked up by a second screw conveyor, apparently larger than the first, which feeds the mixture through a conduit to the applicator. The vehicle travels in the pipe on two sets of support wheels plus a fifth, centrally located steering wheel. This device requires cement to be fed to it from an external source as it performs the lining operation, which necessitates the handling of flexible tubes and the like. In addition, the device is apparently unstable on level ground because of the central steering wheel which extends below the support wheels in order to contact the pipe.

There is thus a need for an improvement to pipe lining apparatus which permits a pipe lining apparatus to be conveyed easily and conveniently to lengths of pipe.

There is further need for an improvement to pipe lining apparatus which permits facilitated alignment of a pipe lining apparatus and a length of pipe.

There is a still further need to provide an improvement to pipe lining apparatus which eliminates the need for handling tubes and conduits for fluid lining material during a lining operation while permitting a complete lining operation in one pass of a lining apparatus through a length of pipe.

SUMMARY OF THE INVENTION

The present invention provides improvements which avoid or minimize the above discussed problems of the prior art and provides additional improvements not found in the prior art. The present invention incorporates a novel cradle and carriage arrangement which permits the convenient transportation and precise positioning of a pipe liner vehicle at the ends of lengths of pipe laid side by side so that they can be treated sequentially.

An improved fluent material reservoir and conveyor arrangement for the pipe liner vehicle gives the vehicle capability to load up with and distribute sufficient liner material for a complete run, and thus eliminates the need for fluent material supply tubes, flexible pipes and the like such as are found in prior art pipe liners.

According to one aspect to the present invention there is provided a pipe lining apparatus for successively lining several lengths of pipe which includes a pipe lining vehicle constructed to move longitudinally inside the pipes. The vehicle includes support elements which ride along the inner surface of a pipe and a distributor arranged to receive pipe liner fluid and to distribute the fluid onto the inner surface of the pipe as the vehicle moves through the pipe. The vehicle is stationed between lining runs on a cradle which has surfaces corresponding to portions of the pipe surface to receive the vehicle as it exits from each pipe upon completing the lining of the pipe. A cradle positioning apparatus constructed as a second vehicle having a carriage supporting the cradle permits the cradle to be moved from pipe to pipe and positioned in each successive lining operation such that the support surfaces are brought into alignment with the ends of the pipes. The carriage has actuators for moving the cradle on the second vehicle in the direction the second vehicle moves.

In another aspect of the invention a pipe lining machine is provided which includes a reservoir for holding fluent lining material and a conduit connecting the reservoir with an element capable of depositing the fluent material on the interior of a pipe. A first screw conveyor extends through the reservoir, while a second screw conveyor of smaller diameter than the first screw conveyor and coaxially aligned with it extends through the conduit. A motive element is provided for rotating the first and second screw conveyors at predetermined relative rates so as to feed the fluent material through the conduit at a desired rate for even distribution of the material while feeding the material through the reservoir to the conduit at a rate which delivers sufficient material for steady feed through the conduit while causing substantially minimal churning of the first screw conveyor through the material in the reservoir. The pipe lining machine is constructed in the form of a vehicle capable of moving through a pipe.

In still another aspect of the invention a pipe lining machine is provided in two sections, a reservoir section for holding fluent lining material and a distributor section. The distributor section is detachably connected to one end of the reservoir section, for receiving fluent lining material from the reservoir section and distributing it onto the inner surface of a pipe.

Two sets of carefully aligned guide wheels are provided, one at each end of the machine. Both sets have the same lateral spacing between the wheels thereof to maintain the lining machine centrally aligned in the pipe. A third set of wheels is positioned on the reservoir section near the distributor section and is provided with a lateral spacing between the wheels thereof which is less than that of the guide wheels so that they do not contact the pipe but do provide support to the reservoir section when the machine is on flat ground. This allows the reservoir section to be supported when removed from the distributor section while avoiding interference with the movement of the machine through the pipe on the guide wheels.

There has thus been outlined the more general aspects of the invention in order that the detailed description thereof that follows may be better understood, and in order that the present contributions to the art may be better appreciated. There are, of course, additional features of the invention that will be described more fully hereinafter. Those skilled in the art will appreciate that the conception on which this disclosure is based may readily be utilized as the basis for the designing of other apparatus for carrying out the several purposes of the invention. It is important, therefore, that this disclosure be regarded as including such equivalent apparatus as to not depart from the spirit and scope of the invention.

BRIEF DESCRIPTION OF THE DRAWINGS

A selected embodiment of the invention has been chosen for purposes of illustration and description, and is shown in the accompanying drawings, forming a part of the specification, wherein:

FIG. 6 is a partial side sectional view of the rearward portion of the vehicle shown in FIG. 4; while FIG. 8 is an enlarged cross sectional view of the drive portion of the vehicle shown in FIG. 4, also taken through a vertical section through the central axis of the vehicle.

DETAILED DESCRIPTION OF THE PREFERRED EMBODIMENT

Figure 1:
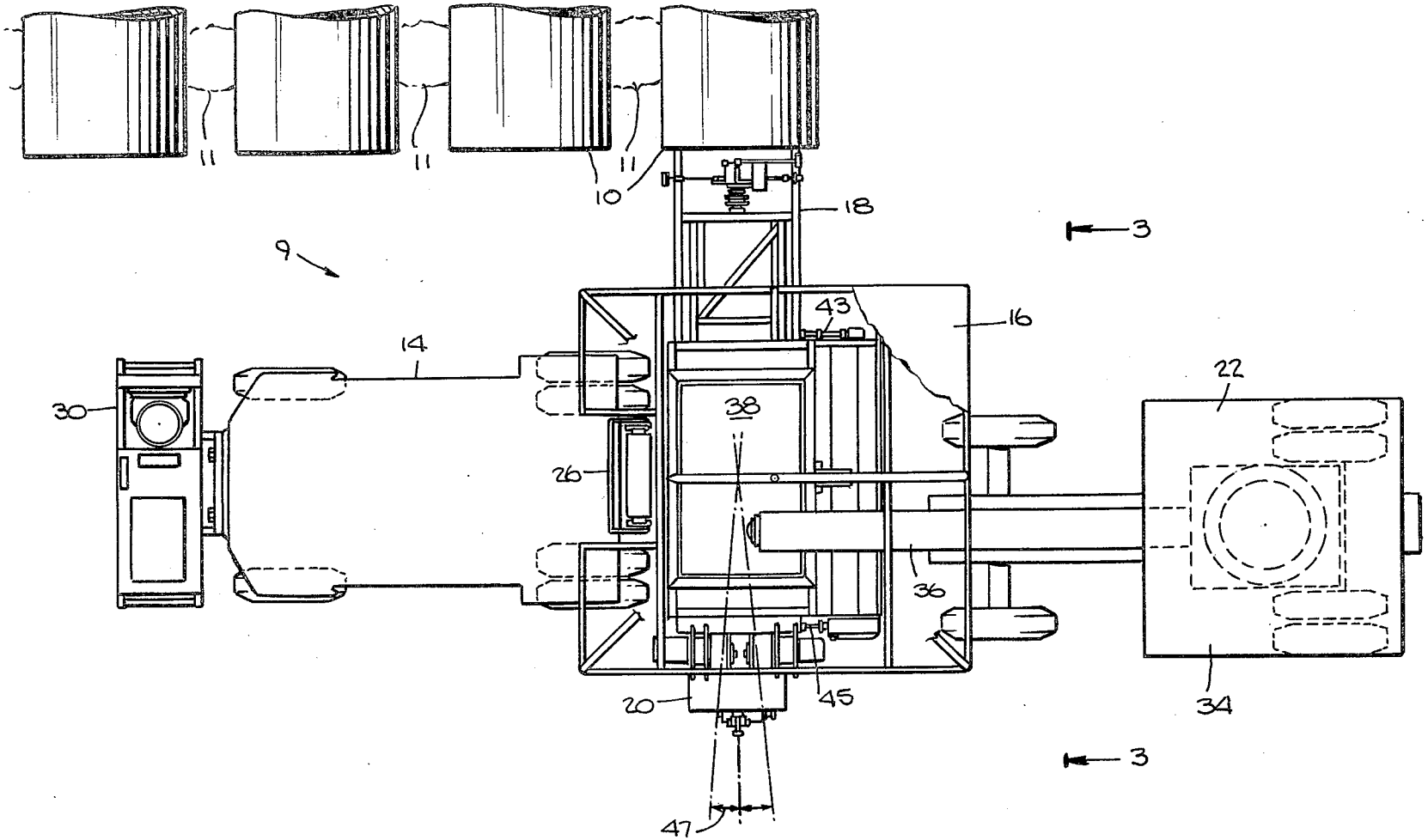
FIG. 1 is a top view of a machine embodying the present invention in its preferred form.
Figure 2:
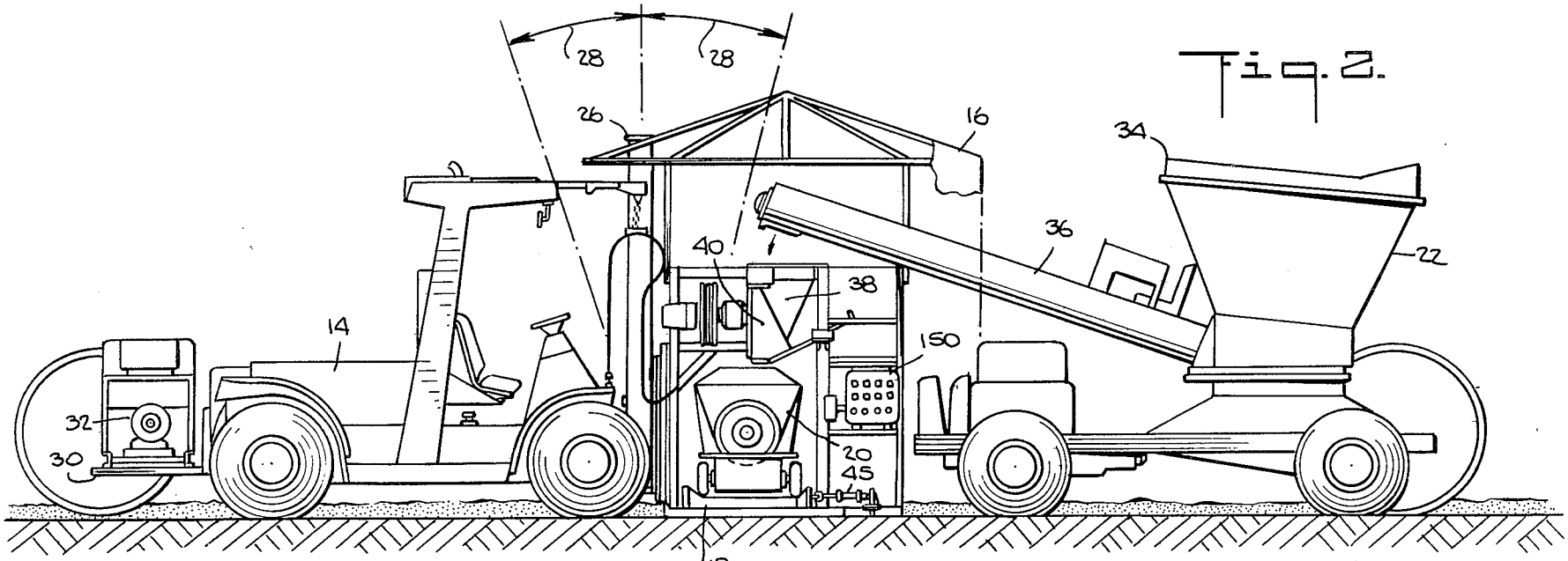
FIG. 2 is a side view of the machine shown in FIG. 1.
Figure 3:
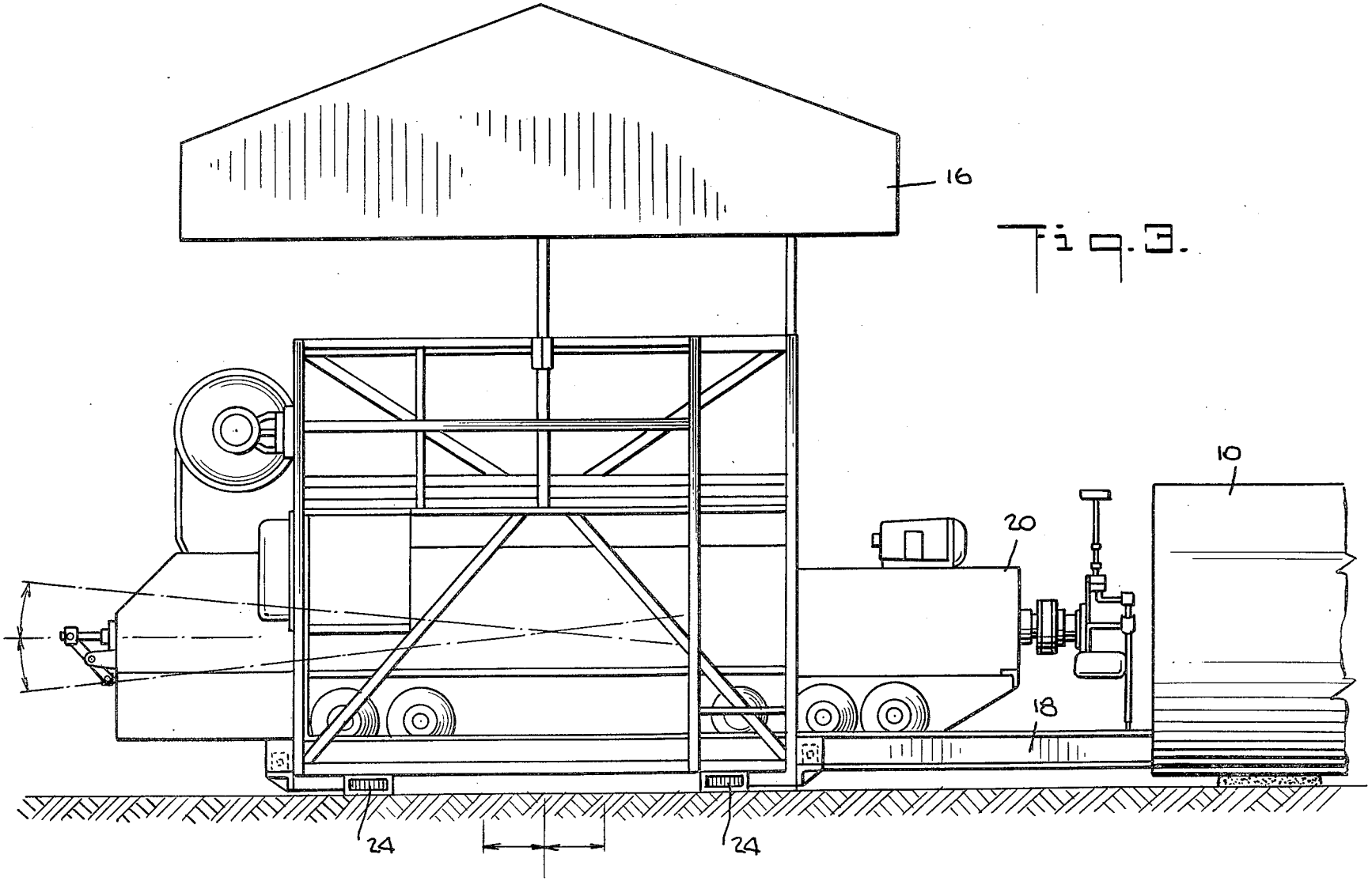
FIG. 3 is a view taken along line 3—3 of FIG. 1.

A pipe lining machine 9 which embodies the present invention in its preferred form is shown in top, side and end view in FIGS. 1, 2 and 3, respectively. Also as shown in these drawings the machine 9 is arranged opposite the end of a pipe 10 to be lined which is one of a row of such pipes resting on the ground and roughly spaced by small mounds of earth 11. Referring to all three figures together this embodiment, which is designed especially for the application of mortar to the interior surfaces of pipes, will now be described.

The pipe lining machine 9 comprises generally a forklift truck 14, a carriage 16, a cradle 18 supported by the carriage 16, a pipe lining vehicle 20 and a mortar transport vehicle 22, as shown.

The forklift truck 14 is a standard commercial design, the one selected for this embodiment being Model No. H-255H, manufactured by Hyster Co., Box 2902, Portland, Oreg. 97208. Comparable models having sufficient lifting capability may be used as well.

In practice, the carriage 16 is supported on the fork 24 of the truck 14, as can be seen in FIG. 3, and can thus be transported conveniently from pipe to pipe. In addition, by virtue of the tilting capability of the fork support frame 26, indicated by arrows 28 in FIG. 2 and the arrows 29 in FIG. 3, the carriage 16 may be tilted about horizontal axes crossways and longitudinal to the forklift truck. This tilting capability is used to align the cradle 18 with a pipe 10, as is described more fully below.

The forklift truck 14 is provided with a bracket 30 to carry an electrical generator 32 for supplying electricity for the operation of the liner.

The mortar transport vehicle 22 is also a standard commercial design. The transfer vehicle 22 which was selected for this embodiment is the "Sidewinder Model 1" manufactured by Martin Concrete Engineering Co., Fort Worth, Tex. 76112. This machine is loaded with mortar at a central mixing plant and then conveys it to the pipelining machine 9. The mortar is fed by way of a conveyor 36 to the carriage 16, where it is directed into a carriage hopper 38.

The carriage hopper 38 is provided with a clamshell type hopper door 40 at the bottom thereof for unloading mortar into a reservoir section 46 (FIG. 4) of the vehicle 20. The hopper door 40 is actuated by an hydraulic actuator 42 mounted on the frame 44 of the carriage 16, as shown. The top of the reservoir section 46 of the liner vehicle 20 is of open construction. This allows a full load of mortar sufficient for a complete lining run to be loaded into the carriage hopper 38 between lining runs and then, when the vehicle 20 is back on the cradle 18, quickly dropped into the open reservoir section 46 readying the vehicle 20 for another run.

A pair of cradle alignment actuators 43, 45 are attached to the frame of the carriage 16 and operate on the cradle 18. These actuators, which are hydraulic piston and cylinder assemblies, aid in aligning the cradle 18 with a pipe 10 once the carriage 16 has been placed as accurately as practicable by means of the forklift truck 14. The actuators 43, 45 permit fine adjustments of the position of the cradle 18 in the direction of motion of the forklift truck 14, and also, by actuation in opposite directions, about a vertical pivot axis, as represented by arrows 47 shown in FIG. 1.

Figure 4:
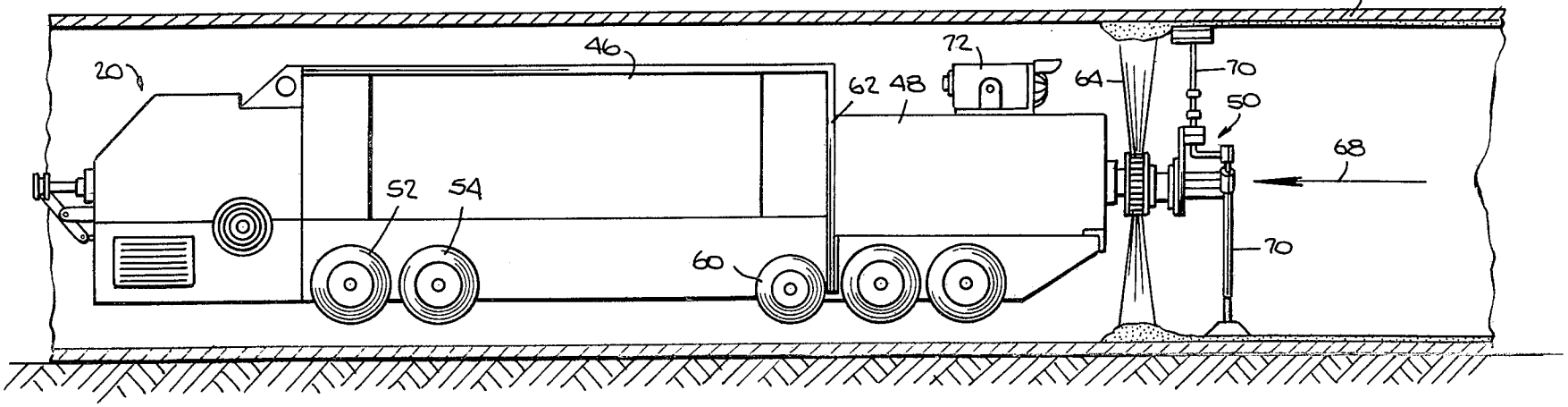
FIG. 4 is a side view of the liner vehicle utilized in connection with the machine shown in FIG. 1, in operation in a pipe which is shown in cross section.

FIG. 4 shows the liner vehicle 20 in the course of a lining run in a length of pipe 10. The vehicle 20 is constructed in two detachable sections the reservoir section 46 and a distributor section 48 which carries a distributor head 50.

The reservoir section 46 has two sets of guide wheels 52, 54 at the end remote from the reservoir section, as shown. Two sets are utilized in this embodiment to provide additional support for the vehicle 20, as it is quite heavy, especially when carrying a full load of mortar.

The distributor section 48 is additionally provided with another two sets of guide wheels 56, 58. These two sets of guide wheels provide additional support, and, in addition, when the distributor head 50 is removed, or the trowel arms 70 retracted, can provide balanced support of the distributor section 48 when it is detached from the reservoir section 46.

A fifth, auxiliary set of wheels 60 is also provided on the reservoir section 46 adjacent the point of attachment 62 between the reservoir section 46 and the distributor section 48. This smaller set of wheels has a lower axle placement than those of guide wheels 52, 54 to make the lower surface of the wheels 60 the same horizontal level as the guide wheels 52, 54. At the same time, the auxiliary wheels 60 are axially spaced a lesser distance than that of the guide wheels 52, 54, 56 and 58. As a result, when the vehicle 20 is inside a pipe 10, such as is shown in FIG. 4, only the guide wheels 52, 54, 56, 58 contact the inner surface of the pipe 10 because the decreased axial spacing of the auxiliary wheels 60 prevents them from reaching the curved inner surface of the pipe 10 which the guide wheels ride on. On the other hand, when the vehicle is on level ground, the auxiliary wheels do contact the ground because this contact surface is then on the same horizontal level as that of the guide wheels 52–58. This also permits the reservoir section 46 to be completely supported on wheels when it is detached from the distributor section 48.

As shown in FIG. 4, the distributor discharges concrete 64 out of the discharge element 66 onto the inner surface of the pipe 10 as the vehicle traverses in the direction indicated by arrow 48. Disposed rearwardly of the discharge element 66 is a set of rotating trowel arms 70 for smoothing the mortar 64 which has been deposited on the inner surface of the pipe 10. Because the distributor head 50 is of conventional design it will not be described in further detail herein.

A light source 72 is provided, as shown to assist in monitoring the lining operation.

Figure 5:
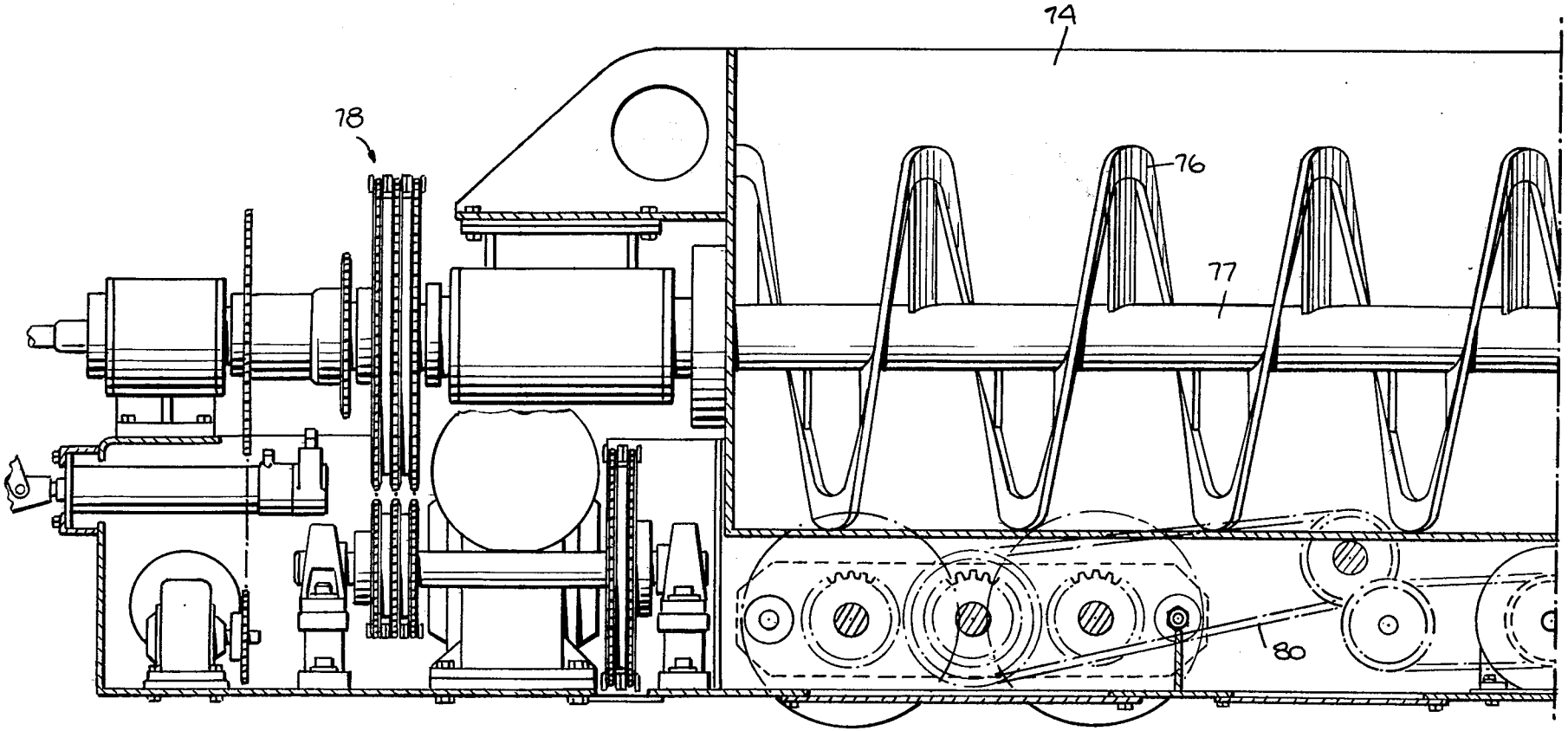
FIG. 5 is a side sectional view of the forward portion of the vehicle shown in FIG. 4.
Figure 5:
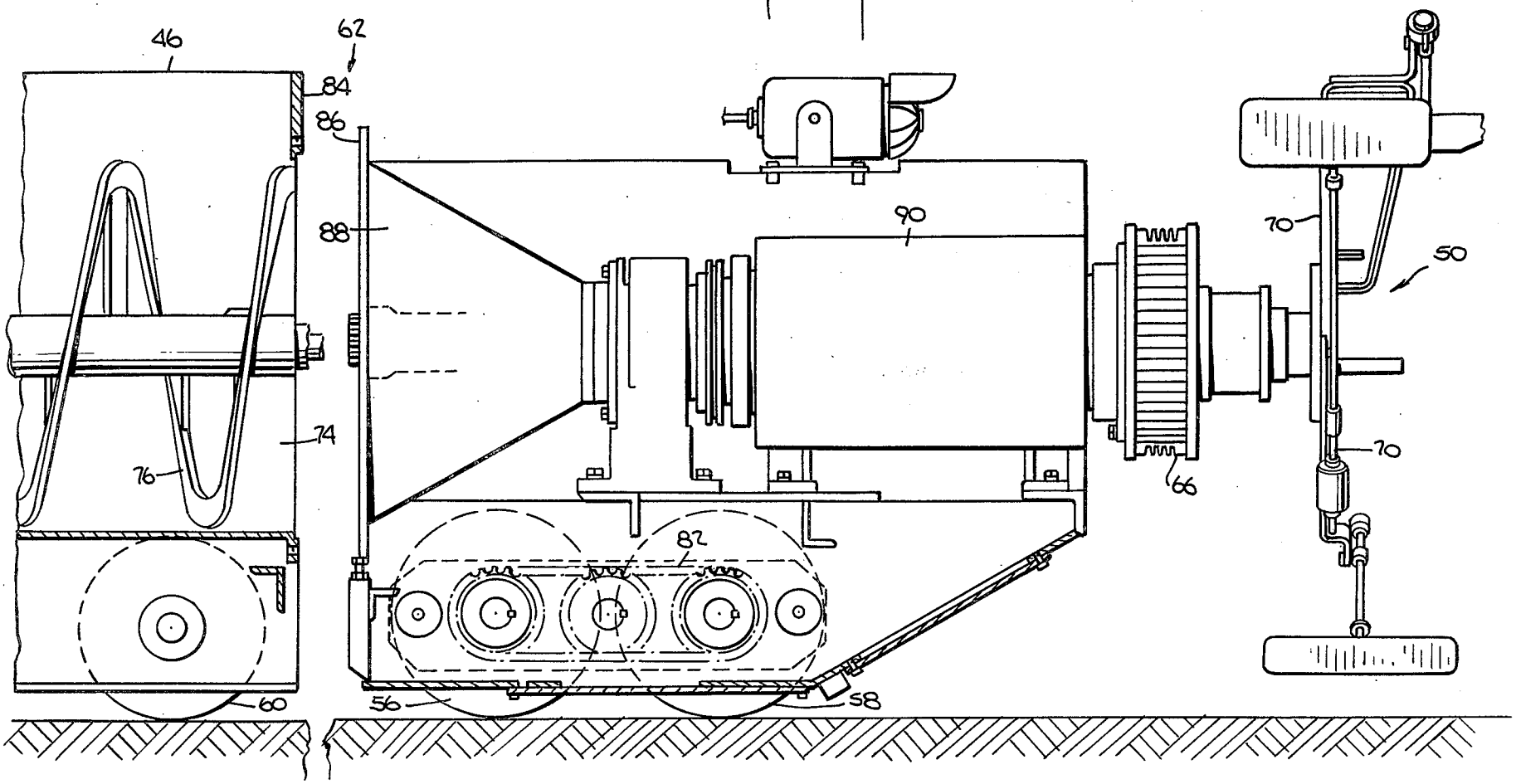

FIG. 5 shows a partial cross sectional view of one end of the reservoir section 46 of the liner vehicle 20. The reservoir section includes an open top reservoir 74 as well as a first screw conveyor 76 which extends its length. This conveyor 76 is of open construction to provide a safeguard against excessive engine loading and also to minimize the effects of "churning" of the mortar as the screw passes through the mortar. Drive for the conveyor 76 is provided by a drive shaft 77.

Also shown in FIG. 5 is an arrangement 78 of motors and chain drives for driving the first screw conveyor drive shaft 77 as well as other drive shafts which are discussed below. This arrangement 78 will be described below in connection with FIG. 7.

The guide wheels 50 and 52 are driven by means of a chain and sprocket drive 80. Since this drive arrangement is conventional and does not constitute the invention per se it will not be described in detail.

Referring now to FIG. 6, a partial cross sectional view of the distributor section 48 and connecting end of the reservoir section are shown on level ground, detached and partially separated. In this view the trowels 70 are shown retracted to avoid interference with the ground. The guide wheels 56 and 58 are provided with a chain and sprocket drive 82 similar to the drive 80 for the reservoir section guide wheels 52, 54. It is likewise of conventional design and will therefore not be described in detail herein. The auxiliary wheels 60 can be seen supporting the detached end 84 of the reservoir section 46 on the level ground.

The end 84 of the distributor section 48 which connects with the reservoir section 46 is provided with an interface 88 having the configuration of a truncated cone. The wide opening of the interface communicates with and receives mortar from the open end of the reservoir 74 when the two sections are joined. The smaller end of the interface 88 communicates with a conduit assembly 90 which will be described in more detail below.

Figure 7:
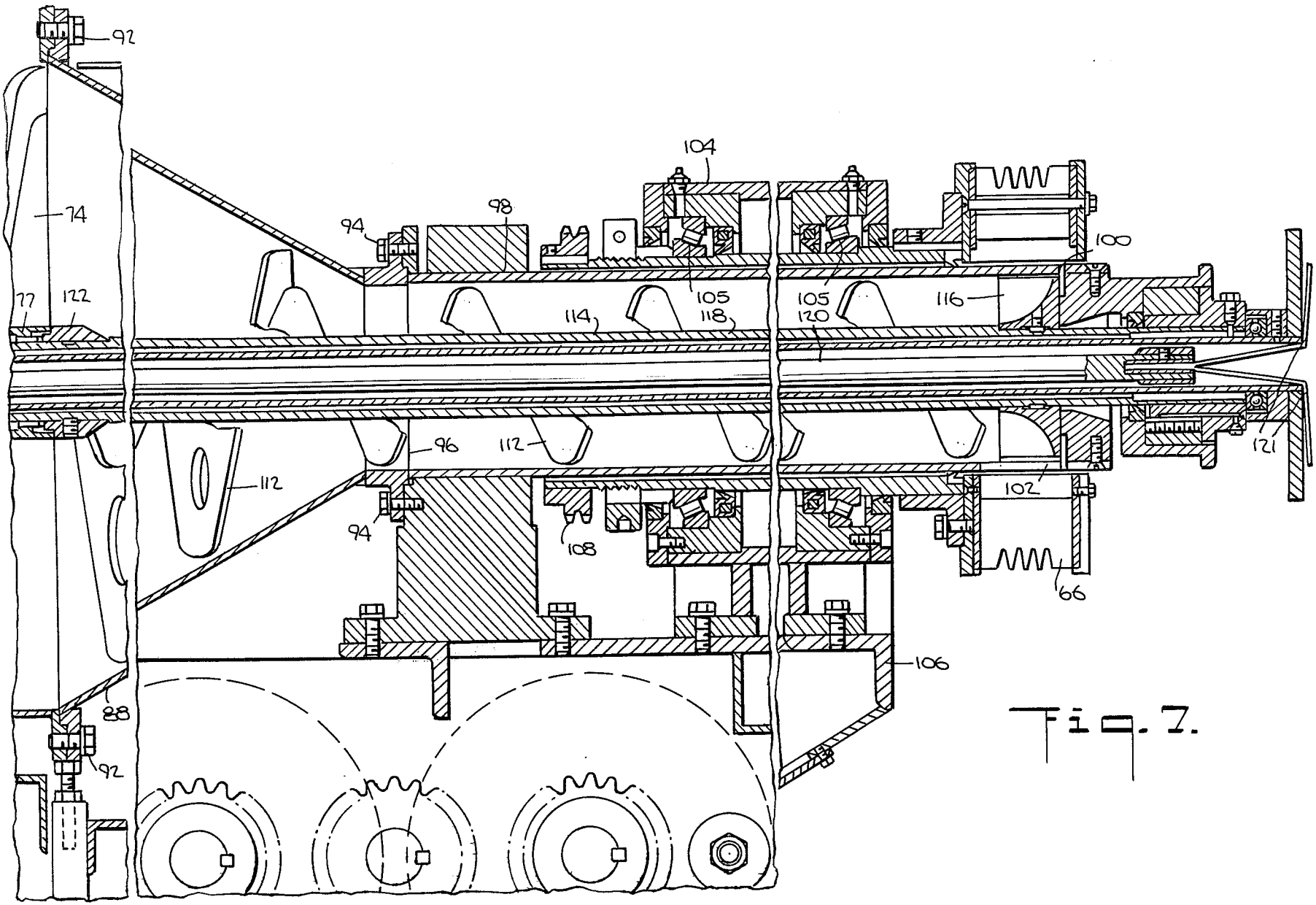
FIG. 7 is an enlarged complete cross sectional view of the rear end of the vehicle shown in FIG. 4, taken through a vertical section through the central axis of the vehicle.
Figure 1:
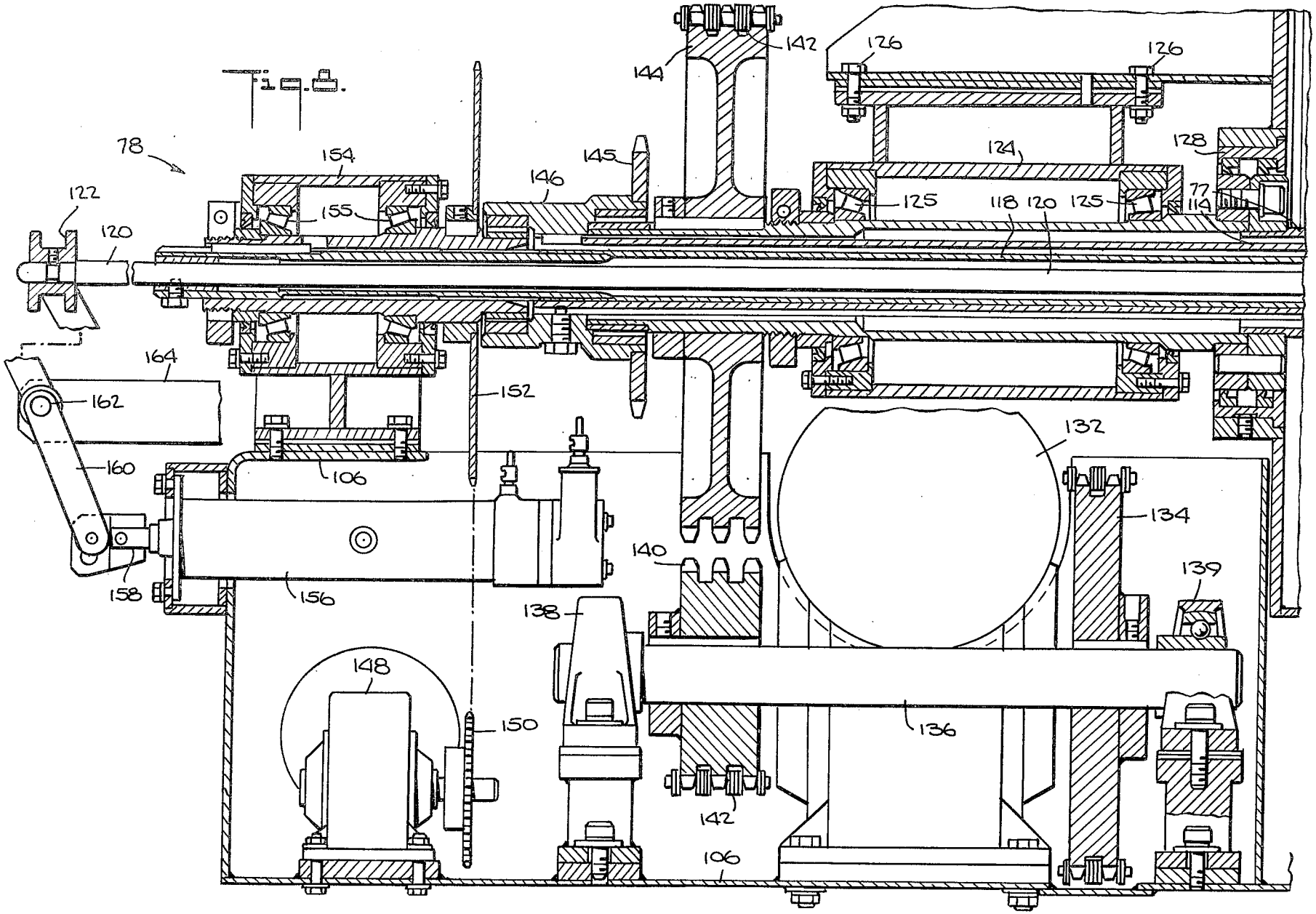

FIG. 7 shows the reservoir section in partial cross section view. The interface 88 and the conduit assembly 90 are shown in broken view. The wide opening of the interface is bolted to the open end of the reservoir 74 by way of bolts 92. The smaller end is bolted by bolts 94 to one end 96 of a cylindrical conduit 98. This conduit 98 communicates at its opposite end 100 with the distributor head 50. Slots 102 are provided around the periphery at end 100 to feed the concrete to the rapidly rotating discharge element 66 in a manner well known in the art.

The discharge element 66 is mounted by way of a bearing housing 104 to the conduit 98 which is thus supported on the frame 106 of the distributor section 48. Roller bearings 105, such as Timken roller bearing type "TS", are positioned in the housing 104 to permit the rotation of the discharge element 66. Drive for the discharge element 66 is communicated by way of a chain (not shown) and sprocket 108 coupled to an electric motor (also not shown). The conduit 98 is supported by way of support 110 which is also mounted on the frame 106.

Throughout the length of the interface 88 and the conduit 98 runs a second screw conveyor. This conveyor 112 is configured so as to conform to the interior of the interface 88 and conduit 98. Thus the screw tapers in diameter through the interface 88 and maintains constant diameter through the cylindrical conduit 98. Drive for the conveyor 112 is provided by way of a hollow drive shaft 114 which terminates in a multi-vane agitator 116. Inside the second screw conveyor drive shaft 114 another drive shaft 118 is provided for the trowel assembly 70, which is not shown in this view. The drive arrangements for both shafts 114 and 118 are described below.

A long rod 120 is provided inside the trowel drive shaft 118, and is used to control the extention of the arms of the trowel assembly by either pulling or releasing wire cables 121 attached to the end of the rod 120, which act against the outwardly spring biased arms, as is known.

Finally, the end of the first screw conveyor drive shaft 77 is fitted into a sleeve 122 attached to the second screw conveyor drive shaft 114.

The drive arrangements for the three drive shafts 77, 114 and 118 for the first and second screw conveyors 76 and 112 and the trowel 70, respectively, will now be described with reference to FIG. 8.

The first screw conveyor drive shaft 77 is supported by way of a bearing housing 124 which in turn, is bolted by way of bolts 126 to the frame 106 of the reservoir section 46. Roller bearings 125, which may also be of the Timken "TS" type, are positioned as shown in the housing 124. The shaft 77 enters the reservoir 74 through a sleeve 128 and seal 130.

An electric motor 132 drives a right angle worm gear reducer having a double ended output shaft (not shown). A chain sprocket on one end of the output shaft (not shown) drives a large sprocket 134 on a shaft 136 supported at both ends by bearing assemblies 138 and 139 mounted on the reservoir section frame 106. A driver sprocket 140 on the shaft 136 in turn drives the shaft 77 by way of a chain 142 and sprocket 144. The other end of the double ended output shaft has another sprocket (not shown) which drives the shaft 114 by way of an associated driven sprocket 145. This driven sprocket 145 is mounted directly on a bearing 46, such as McGill bearing #GR-64RSS and Ml-56.

Drive for the trowel drive shaft 118 is provided by way of another electric motor 148 which drives a driver sprocket 150, chain (not shown) and driven sprocket 152. Support for the shaft 118 is provided by way of a roller housing 154 mounted on the reservoir section frame 106, which contains roller bearings 155, for example Timken "TS" type, as shown.

Finally, retraction of the retractor rod 120 is effected by way of an actuator 156, the shaft 158 of which is connected to one end of a pivot arm 160 connected by way of a pivot pin 162 to an extension 164 of the reservoir section frame 106. The other end of the pivot arm 160 is connected to a collar 166 attached to the end of the retractor rod 120. By extending the shaft 158 of the actuator 156 the retractor rod 120 is moved in the opposite direction thereby extending the arms of the trowel assembly 70 (FIG. 4) as described above.

Referring now to all of the Figures, a series of pipe lining operations will now be described. Initially, the liner vehicle is placed on the cradle 18 in position under the carriage hopper 38. The forklift forks 24 are then placed under the carriage 16 and lifted. The forklift truck 14 with supported carriage 16 is then driven to the end of the first pipe 10 and, using the maneuvering capability of the forklift 14 and the tilting capability of the fork support frame 28, the carriage 16 is placed so that the cradle 18 is aligned with the end of the pipe.

However, even a skilled forklift operator is able to only roughly align the cradle 18 with a pipe 10, and not accurately enough to assure that the liner vehicle 20 will be able to pass smoothly into the pipe. To achieve precise adjustment of the cradle position, the actuators 43 and 45 are activated to provide precise translational adjustments transverse to the pipe axis, as well as precise pivotal adjustments about a vertical axis extending through the center of the cradle 18 between the actuators 43, 45.

The cradle 18 is provided with tracks on either side extending along its entire length. These tracks correspond to a portion of the interior of a pipe of the same diameter as the pipe to be lined. In the aligning operation, the tracks are positioned so that they line up with the corresponding portions of the pipe to be lined on which the wheels will ride. The wheels are thus provided with a virtually continuous track from cradle to pipe when the cradle is aligned.

In addition, since large pipes are frequently stored side by side on the ground, a number of such pipes can be lined in this manner without need for moving the pipes, either before or after the lining operation. The forklift is simply driven along the ends of the pipes, stopping at each pipe for a lining operation, without the need for time consuming and ultimately futile attempts at maneuvering the forklift to precisely align the cradle 18.

When the cradle 18 is thus aligned to the satisfaction of the user at the end of the pipe 10, the transport vehicle 22 is activated to deposit into the carriage hopper 38 an amount of mortar sufficient for a complete pipe lining operation. The hopper door 40 is then opened, depositing the mortar into the open top reservoir 74 of the vehicle 20. The vehicle 20, with trowels 20 retracted, is then advanced into the pipe 10 until the distributor head 50 is at the far end of the pipe 10.

The lining process itself is then begun by extending the trowels 70, activating both screw conveyors 76 and 112, rotating the discharge element 66 and trowels 70, and slowly backing the vehicle 20 out of the pipe 10. The vehicle 20 continues out the pipe onto the cradle 18 and, when the distributor head 50 reaches the near end of the pipe 10, the screw conveyors 76 and 112, the discharge element 66, and the trowel assembly 70 are all disengaged, stopping the lining process, and the vehicle continues along the cradle until stationed beneath the carriage hopper 38.

As the lining process is proceeding, another load of concrete for the next lining operation is deposited into the hopper 38. When the vehicle is returned to its station beneath the hopper 38 this load can be loaded immediately into the reservoir 74 for the next run. The machine 9 is then driven to the next pipe, the cradle is aligned as before, and the process is thus repeated until all pipes 10 are lined.

Electricity for the various driver motors for the shafts, screw conveyors and wheels is supplied by way of one or more electrical cables (not shown) connected to the vehicle 20 and fed out by a spring tensioned reel (not shown), for example. Thus the generator for electricity supply need not be mounted on the vehicle 20, but may, for example, be mounted on the forklift 14, as was described above in connection with FIG. 2.

Starting and stopping the various motors is effected by way of a conventional push button panel 150 (FIG. 2) which is connected electrically to the motors by way of another electrical cable (not shown) also fed out by a spring tensioned reel (not shown).

The relative drive rates for the two screw conveyors will be determined by the difference in the cross sectional areas of the reservoir 74 and conduit 98. They are adjusted so that the second conveyor 112 delivers mortar to the discharge element 66 at a desired rate, according to principles well known in the art, and so that the first conveyor 76 delivers sufficient mortar to the first conveyor for steady feed of the mortar through the conduit 98 but while causing substantially minimal "churning" of the first conveyor 76 through the mortar, thus minimizing loading on the first conveyor drive motor 132. This can be arrived at empirically or calculated on the basis of the aforementioned differences in cross sectional areas of the reservoir 74 and conduit 98.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A pipe lining apparatus for successively lining several lengths of pipe, said apparatus comprising:

a pipe lining vehicle constructed to move longitudinally inside said pipes, said vehicle including support elements which ride along the inner surface of the pipe and a distributor arranged to receive pipe liner fluid and to distribute the fluid onto the inner surface of the pipe as the vehicle moves through the pipe;

a cradle having surfaces corresponding to portions of the pipe surface to receive said vehicle as it exits from each pipe upon completion of lining of the pipe; and a cradle positioning apparatus for successively positioning said cradle, with said vehicle mounted thereon, such that said support surfaces are brought into alignment with the ends of said pipes, said cradle apparatus comprising a second vehicle moveable in a given direction from one pipe to the next and a carriage on the second vehicle supporting said cradle, said carriage including first actuators for moving the cradle on the second vehicle in said direction to position said first vehicle accurately.

2. A pipe lining apparatus according to claim 1 wherein said cradle positioning apparatus further comprises second actuators for pivoting said cradle about a vertical axis.

3. A pipe lining apparatus according to claim 1 wherein said pipe lining vehicle includes a reservoir for receiving a load of the fluent material for transport to the interior of the pipe and wherein said cradle positioning apparatus is provided with a receptacle for receiving a load of the fluent material and depositing it in said reservoir when said vehicle is being carried by said carrier means.

4. A pipe lining apparatus according to claim 3 wherein said carriage is provided with a receptacle for receiving a load of fluent material and depositing it in said reservoir when said vehicle is being carried by said carrier means.

5. A pipe lining apparatus according to claim 4 wherein said receptacle comprises a hopper having means for controllably releasing the received load from said hopper.

6. A pipe lining apparatus according to claim 5 wherein said releasing means comprises a clam shell type gate disposed at the bottom of said hopper.

7. A pipe lining apparatus according to claim 1 wherein said second vehicle comprises a forklift truck.

8. A pipe lining machine comprising:

a reservoir for holding fluent lining material;

a first screw conveyor extending through said reservoir;

distributor means for distributing said material onto the interior of a pipe;

a conduit connecting said reservoir to said depositing means;

a second screw conveyor of smaller diameter than said first screw conveyor and coaxially aligned therewith extending through said conduit for feeding said material to said depositing means;

means for rotating said first and second screw conveyors at predetermined relative rates to feed the material through said conduit at a desired rate while feeding the material through said reservoir to said conduit at a rate which delivers sufficient material for steady feed through said conduit while causing substantially minimal churning of said first screw conveyor through said material; and means for transporting said machine through the pipe.

9. A pipe lining machine according to claim 8 wherein said reservoir comprises a trough.

10. A pipe lining machine according to claim 9 wherein the helical plate of said first screw conveyor is of partially open configuration about the shaft thereof.

11. A pipe lining machine according to claim 9 further comprising a transitional chamber connecting said trough to said conduit.

12. A pipe lining machine according to claim 11 wherein said transitional chamber is shaped in the form of a truncated cone open at both ends, the large area opening communicating with said trough and the smaller area opening communicating with said conduit.

13. A pipe lining machine according to claim 12 wherein said first screw conveyor extends into said transition chamber and the helical plate thereof in said transition chamber tapers in radial extension to accomodate the conical taper of said chamber.

14. A pipe lining machine according to claim 8 wherein said means for depositing comprises a slotted rotating head which throws said fluent material outwardly by centrifugal action to be deposited on the interior of the pipe.

15. A pipe lining machine according to claim 14 wherein said means for depositing further comprises means for smoothing the deposited material.

16. A pipe lining machine according to claim 15 wherein said smoothing means comprises a plurality of rotatable trowels arranged for coaxial rotation with respect to said rotating head.

17. A pipe lining machine according to claim 8 wherein said conduit comprises a cylindrical carrier pipe.

18. A pipe lining machine according to claim 17 wherein said second screw conveyor fits closely in said carrier pipe.

19. A pipe lining machine comprising:

a reservoir section for holding fluent lining material;

a distributor section detachably connected to one end of said reservoir section for receiving the lining material therefrom and distributing the material onto the interior of a pipe;

a rearward set of guide wheels mounted on said reservoir section near the end thereof remote from said distributor section;

a forward set of guide wheels mounted on said distributor section, the wheels of said rearward and forward sets having a lateral spacing between the wheels thereof a first distance to maintain said lining machine centrally aligned in the pipe; and a third set of wheels on said reservoir section near said distributor section, having a lateral spacing between the wheels thereof a second distance less than said first distance, to avoid contact with the pipe but to contact a flat surface when said machine is removed from the pipe thereby allowing said reservoir section to be separated from said distribution section while being supported on the ground.

* * * * *

UNITED STATES PATENT AND TRADEMARK OFFICE

CERTIFICATE OF CORRECTION

PATENT NO. : 4,329,937

DATED : May 18, 1982

INVENTOR(S) : Henry A. Nelson Holland

It is certified that error appears in the above—identified patent and that said Letters Patent is hereby corrected as shown below:

Cover sheet, item [56], References Cited, add

-- 3,810,441 5/1974 Padgett, et al ..... 118/105 --.

Signed and Sealed this

Nineteenth Day of October 1982

[SEAL]

*Attest:*

GERALD J. MOSSINGHOFF

*Attesting Officer*

*Commissioner of Patents and Trademarks*